US006585397B1

(12) United States Patent
Ebiko

(10) Patent No.: US 6,585,397 B1
(45) Date of Patent: Jul. 1, 2003

(54) REFLECTOR FOR A PROJECTION LIGHT SOURCE

(75) Inventor: Naoki Ebiko, Kanagawa-ken (JP)

(73) Assignee: Fujitsu General Limited, Kawasaki (JP)

( * ) Notice: Subject to any disclaimer, the term of this patent is extended or adjusted under 35 U.S.C. 154(b) by 0 days.

(21) Appl. No.: 09/913,841

(22) PCT Filed: Jan. 19, 2001

(86) PCT No.: PCT/JP01/00345

§ 371 (c)(1),
(2), (4) Date: Aug. 16, 2001

(87) PCT Pub. No.: WO01/53743

PCT Pub. Date: Jul. 26, 2001

(30) Foreign Application Priority Data

Jan. 20, 2000 (JP) ..... 2000-011261

(51) Int. Cl.[7] ..... F21V 7/00

(52) U.S. Cl. ..... 362/297; 362/296; 362/304; 362/305; 362/307; 362/341; 362/347; 313/113; 359/223; 359/311; 359/838

(58) Field of Search ..... 362/297, 296, 362/304, 305, 307, 346, 349, 350, 341, 347; 313/113; 359/223, 311, 838

(56) References Cited

U.S. PATENT DOCUMENTS 1,726,379 A * 8/1929 Benford ..... 362/297
4,034,217 A * 7/1977 Dumont ..... 362/297
4,254,455 A * 3/1981 Neal, Jr. ..... 362/296
4,992,695 A * 2/1991 Naum ..... 313/113
5,093,601 A * 3/1992 Watanabe et al. ..... 313/113
5,493,170 A * 2/1996 Sheppard et al. ..... 313/113
6,168,293 B1 * 1/2001 Lieszkovszky et al. ..... 362/297

* cited by examiner

*Primary Examiner*—Sandra O'Shea
*Assistant Examiner*—James W Cranson, Jr.
(74) *Attorney, Agent, or Firm*—Flynn, Theil, Boutell & Tanis, P.C.

(57) ABSTRACT

The object of the present invention is to effectively utilize the light rays emitted from a light source lamp 1, and, for accomplishing this object, a reflector 2 is made up of a first parabolic reflector 3 designed for reflecting light rays coming from the light source lamp 1 to be outputted as light rays parallel to the optical axis 6, second parabolic reflector 4 designed for reflecting light rays coming from the light source lamp 1 as outwardly inclined parallel light rays, and circular truncated conic reflector 5 for reflecting light rays coming from the second parabolic reflector 4 and outputted as light rays parallel to the optical axis 6. In this fashion, light rays which cannot be outputted due to being in the shadow of the spherical light source lamp can be outputted as light rays parallel to the optical axis 6.

9 Claims, 1 Drawing Sheet

REFLECTOR FOR A PROJECTION LIGHT SOURCE

TECHNICAL FIELD

The present invention relates to an illumination light source unit to be used for a liquid-crystal projector and the like and is designed for efficient reflection of light rays.

BACKGROUND ART

In the case of an illumination light source unit to be used for a liquid crystal projector, a light source lamp is placed at the focal point of a parabolic reflector so that the light rays emitted from the light source lamp are reflected by the parabolic reflector to be outputted as.parallel light rays. However, the light rays reflected near the optical axis (near the base of the light source lamp) are diffracted by being reflected by the surface of a spherical lamp due to the effect of the shadow of the light source lamp, so that the diffracted light rays cannot be used effectively as parallel light rays.

The present invention is intended to eliminate the problem of the prior art and designed to increase the luminance of the projected picture by converting into parallel rays the light rays reflected near the optical axis of the parabolic reflector of the illumination light source, thereby improving the utilization rate of the light source.

DISCLOSURE OF THE INVENTION

The present invention is intended to resolve the above-mentioned problem and the reflector of the illumination light source unit according to the present invention comprises a first parabolic reflector, for reflecting light rays coming from a light source lamp, having a paraboloid with a focal point coincident with the center of the light-emitting part of the light source and forming a portion of the reflector not including the portion corresponding to the external contour of the light source lamp with respect to the optical axis as being the center thereof, a second parabolic reflector forming the portion of the reflector, for reflecting light coming from the light source lamp towards the rim of the opening of the first parabolic reflector, not including the first parabolic reflector but including a paraboloid having a focal point eccentric from the center of the light-emitting part of the light source lamp, and a bottomless circular truncated conic reflector so that light rays from the light source are reflected to become parallel light rays to be outputted.

The first parabolic reflector, the second parabolic reflector and the circular truncated conic reflector may be formed integrally, or the circular truncated conic reflector alone may be formed separately to be mounted on the rim of the opening of the first parabolic reflector.

All the reflecting surfaces of the first parabolic reflector, the second parabolic reflector and the circular truncated conic reflector may be provided with a dichroic reflecting film capable of reflecting only the visible light rays respectively, or the reflecting surfaces of both the first parabolic reflector and the second parabolic reflector may be provided with a dichroic reflecting film capable of reflecting only visible light rays while the reflecting surface of the circular truncated conic reflector may be provided with a metallic reflecting film or may be made into a total reflector provided with an aluminum reflecting surface. When providing the circular truncated conic reflector as a total reflection reflector, it is preferable to be formed independently for ease of forming.

Further, the first parabolic reflector and the second parabolic reflector may be formed of glass, and the reflecting surfaces thereof may be provided with a dichroic reflecting film capable of reflecting only visible light rays.

BEST MODE FOR CARRYING OUT THE INVENTION

An embodiment of the present invention will be described below referring to FIG. 1.

Figure 1:
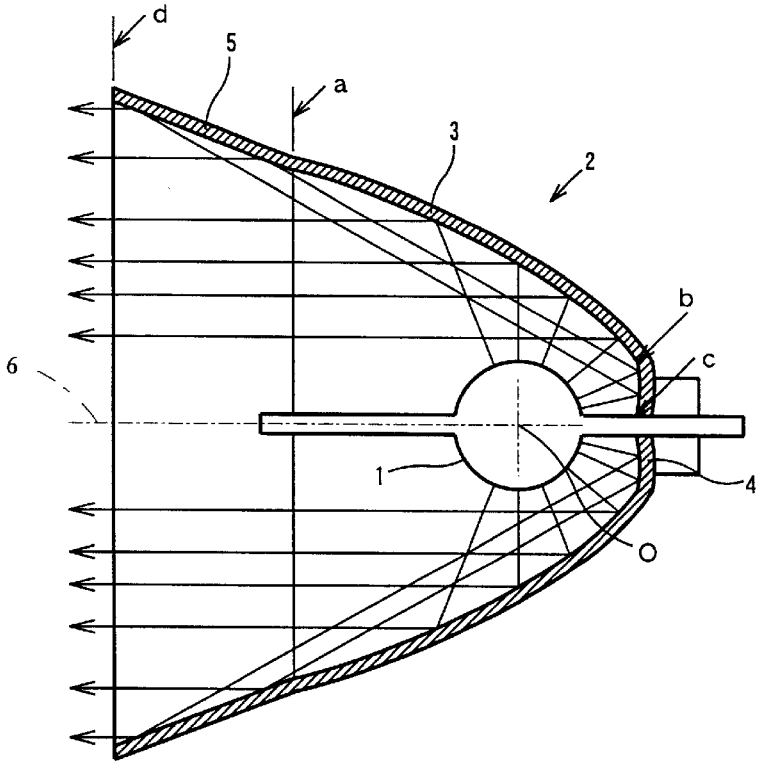
FIG. 1 is a sectional view showing the principal parts of the illumination light source unit as an embodiment of the present invention.

In FIG. 1, the numeral 1 represents the light source lamp; 2, the reflector; 6, the optical axis. The reflector 2 comprises a first parabolic reflector 3 (portion ranging from line a to line b), second parabolic reflector 4 (portion ranging from line b to line c), and bottomless circular truncated conic reflector 5 (portion ranging from line a to line d), which are formed integrally.

The first parabolic reflector 3 comprises a portion corresponding to the external contour of the light source lamp 1, that is, the portion ranging from the line a to line b, not including the second parabolic reflector 4, so that the internal surface (reflecting surface) thereof constitutes a paraboloid with its focal point coincident with the center of the light-emitting part of the light source lamp 1. However, the first parabolic reflector 3 is composed of a paraboloid of revolution with its axis coincident with the central axis of the parabola. The reflecting surface is provided with a dichroic film capable of reflecting only the visible light rays.

The second parabolic reflector 4 is composed of a portion ranging from the line b to line c corresponding to the external contour of the light source lamp 1 having an optical axis 6 and an internal surface formed of a paraboloid having its focal point coincident with the center of the light-emitting part of the light source lamp 1.

However, the second parabolic reflector 4 is composed of a paraboloid of revolution formed with respect to the line between the apex of the parabola and the eccentric focal point so that the optical axis is inclined towards the outside at an angle at which the light rays from the light source lamp 1 are reflected in the direction of the circular truncated conic reflector 5. The reflecting surface is provided with a dichroic film, which is similar to the one provided with the first parabolic reflector 3.

The circular truncated conic reflector 5 comprises a bottomless circular truncated conic internal surface formed along the rims a through d at the opening of the first parabolic reflector 3 so that the parallel light rays reflected by the second parabolic reflector 4 are reflected in the direction parallel to the optical axis 6. The reflecting surface is provided with a dichroic film, which is similar to one provided with the first parabolic reflector 3.

Next, the illumination light source unit having the composition as is discussed above will be described in the following.

The light rays from the light source lamp 1 are radially propagated to fall on various parts of the reflector 2. Of the light rays falling on the second parabolic reflector 4, only the visible light rays are reflected in the direction parallel to the optical axis 6 and outputted. Of the light rays striking the second parabolic reflector 4, only the visible light rays are reflected towards the circuit truncated conic reflector 5 so that the light rays are reflected by the circular truncated conic reflector 5 in the direction parallel to the optical axis 6 and outputted. In this fashion, all the visible light rays emitted from the light source lamp 1 and reflected by the reflector 2 are outputted as light rays parallel to the optical axis 6.

Next, another embodiment of the present invention will be described below referring to FIG. 2.

Figure 2:
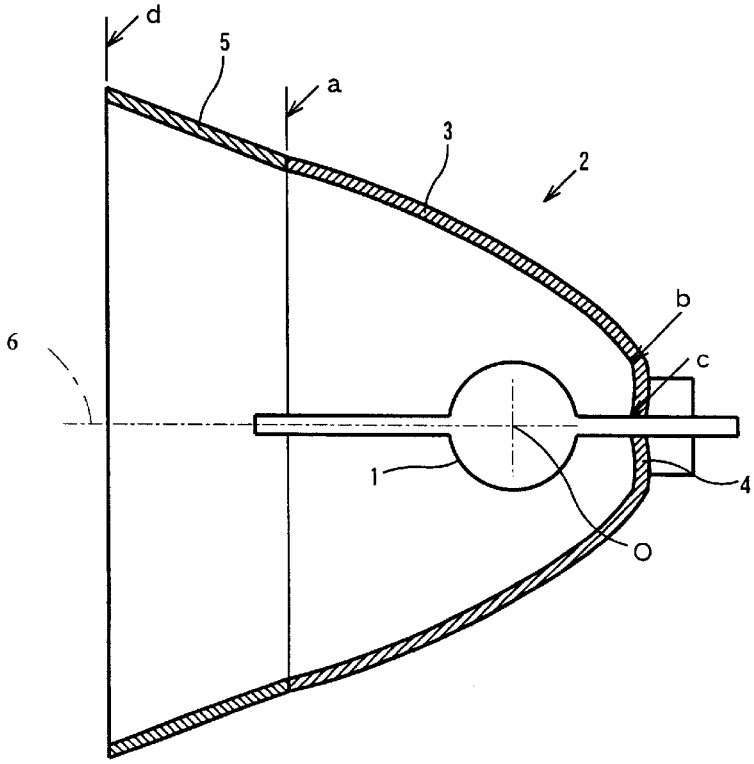
FIG. 2 is another sectional view showing the principal parts of the illumination light source unit as another embodiment of the present invention.

The embodiment shown in FIG. 2 is substantially similar to the embodiment shown in FIG. 1. The embodiment shown in FIG. 2, however, differs from that shown in FIG. 1 in that the circular truncated conic reflector 5 is formed separately from the first parabolic reflector 3 and the second parabolic reflector 4 which are formed integrally, and mounted on the rim of the opening of the first parabolic reflector 3 to form the reflector 2.

The function of the embodiment shown in FIG. 2 will be omitted here, since its function is similar to that of the embodiment shown in FIG. 1.

For the embodiments shown in FIG. 1 and FIG. 2 respectively, the materials from which the reflectors 3, 4 and 5 are to be formed are not mentioned, but various kinds of synthetic resins, metals, as aluminum, and glass may be used.

In each of the embodiments discussed previously, the dichroic film is capable of reflecting only visible light rays against the.reflecting surfaces of the reflectors 3, 4 and 5, but the present invention is not limited to these embodiments. For instance, the reflecting surface of the circular truncated conic reflector 5 may be provided with a metallic total reflection film. Further, the circular truncated conic reflector 5 may be an aluminum reflector (total reflector). This is because the light rays reflected by the second parabolic reflector 4 to fall on the circular truncated conic reflector 5 have been reduced to visible rays by the dichroic film formed over the reflecting surface of the second parabolic reflector 4. In this case, it is easier during fabrication to form the circular truncated conic reflector 5 separately, so that the embodiment shown in FIG. 2 is preferable.

INDUSTRIAL APPLICABILITY

As discussed in the foregoing, with the illumination light source unit according to the present invention, it becomes possible to output light rays in the shadow of the spherical light source lamp as parallel light rays for the effective use of the light rays from the light source, thereby enabling the light source unit to be used for a liquid crystal projector, which requires a light source unit capable of providing a higher luminance.

What is claimed is:

1. An illumination light source unit comprising a light source lamp having a light emitting part and a reflector for outputting parallel light rays by reflecting light rays from the light emitting part, said reflector comprising:

a first parabolic reflector having a forward end, a rearward end and a focal point coincident with the center of the light emitting part and not having a portion corresponding to the external contour of the light source lamp and being centered around the optical axis for reflecting light rays from the light source lamp;

a second parabolic reflector provided at the rearward end of the first parabolic reflector and having a parabolic surface with a focal point eccentric from the center of the light-emitting part for reflecting light rays from the light-emitting part toward the forward end of the first parabolic reflector; and a bottomless circular truncated conic reflector provided at the forward end of the first parabolic reflector for reflecting light rays reflected by the second parabolic reflector in a direction parallel to the optical axis.

2. The illumination light source unit of claim 1, wherein the reflector consists essentially of the first parabolic reflector, second parabolic reflector and bottomless circular truncated conic reflector.

3. The illumination light source unit of claim 1, wherein the reflector consists of the first parabolic reflector, second parabolic reflector and bottomless circular truncated conic reflector.

4. An illumination light source unit according to claim 1, wherein the first parabolic reflector, the second parabolic reflector and the circular truncated conic reflector are formed integrally.

5. An illumination light source unit according to claim 1, wherein the first parabolic reflector and the second parabolic reflector are formed integrally and the circular truncated conic reflector is formed separately and mounted on the forward end of the first parabolic reflector.

6. An illumination light source unit according to claim 1, wherein a dichroic film capable of reflecting only visible light rays is provided over reflecting surfaces of each of the first parabolic reflector, the second parabolic reflector and the circular truncated conic reflector.

7. An illumination light source unit according to claim 5, wherein reflecting surfaces of the first parabolic reflector and the second parabolic reflector are provided with a dichroic film capable of reflecting only visible light rays and a reflecting surface of the circular truncated conic reflector is provided with a metallic reflecting film.

8. An illumination light source unit according to claim 5, wherein a dichroic reflecting film capable of reflecting only visible light rays is formed over reflecting surfaces of the first parabolic reflector and the second parabolic reflector and the circular truncated conic reflector comprises an aluminum reflector.

9. An illumination light source unit according to claim 5, wherein the first parabolic reflector and the second parabolic reflector are formed from glass and reflecting surfaces thereof are provided with dichroic films capable of reflecting only visible light rays and the circular truncated conic reflector is an aluminum reflector.

* * * * *